US006874623B2

(12) United States Patent
Bray

(10) Patent No.: US 6,874,623 B2
(45) Date of Patent: Apr. 5, 2005

(54) SMOKING ARTICLE PACKAGING

(75) Inventor: Andrew Jonathan Bray, Hedge End (GB)

(73) Assignee: Brown & Williamson Tobacco Corporation, Louisville, KY (US)

( * ) Notice: Subject to any disclaimer, the term of this patent is extended or adjusted under 35 U.S.C. 154(b) by 116 days.

(21) Appl. No.: 10/296,307

(22) PCT Filed: May 22, 2001

(86) PCT No.: PCT/GB01/02233

§ 371 (c)(1),
(2), (4) Date: Nov. 21, 2002

(87) PCT Pub. No.: WO01/89962

PCT Pub. Date: Nov. 29, 2001

(65) Prior Publication Data

US 2003/0164314 A1 Sep. 4, 2003

(30) Foreign Application Priority Data

May 23, 2000 (GB) ..... 0012469

(51) Int. Cl.[7] ..... B65D 85/10

(52) U.S. Cl. ..... 206/264; 206/268; 206/273; 229/160.1

(58) Field of Search ..... 206/264, 268, 206/271, 273; 229/160.1

(56) References Cited

U.S. PATENT DOCUMENTS 4,938,363 A * 7/1990 Amendola ..... 206/264
6,164,444 A * 12/2000 Bray et al. ..... 206/268
6,237,760 B1 * 5/2001 Parker et al. ..... 206/273

* cited by examiner

*Primary Examiner*—Bryon P. Gehman
(74) *Attorney, Agent, or Firm*—Charles I. Sherman; Middleton & Reutlinger

(57) ABSTRACT

The invention relates to a smoking article package, which package comprises a sealed enclosure (1) around a charge of smoking articles and a sheet material wrap (7) disposed exteriorly of the enclosure (1). The sheet material wrap (7) is so configured as to provide means by which the first opening of the enclosure (1) cannot take place without the wrap (7) being torn or partially or fully removed.

21 Claims, 2 Drawing Sheets

SMOKING ARTICLE PACKAGING

The subject invention relates to the packaging of smoking articles, such as for example cigarettes, cigarillos and cigars.

It has been proposed to package cigarettes by providing about a charge of cigarettes a sealed enclosure of sheet barrier material, which enclosure comprises a cigarette removal access aperture and a cover layer, which cover layer serves to sealingly close the access aperture. In that the cover layer comprises at the under face thereof a marginal zone of permanently tacky adhesive, after the cover layer has been peeled back to open the access aperture to permit the removal of a cigarette from the package, the cover layer may be reapplied against the exterior face of the barrier material of the enclosure about the periphery of the access aperture, thus to reseal the enclosure.

The access aperture may be provided by cutting the barrier material in a closed figure, a rectangle for example, and removing the thus defined portion of the barrier material, in which case the material of the cover layer is preferably a barrier material. The access aperture may alternatively be provided by cutting the barrier material in a closed figure but, instead of removing the portion of barrier material defined by the line of cut, applying the cover layer over and adhering the cover layer to that portion of the barrier material. Thus according to this alternative, when the cover layer is peeled back, the aforesaid portion of the barrier material is removed from the aperture and is reinserted therein when the cover layer is brought again to the aperture closure position thereof. As disclosed in the specification and drawings of WO98/22367, instead of providing a line of cut in a closed figure, a line of cut, or a line of weakening, may be provided such as to define a flap, the cover layer being adhered to the flap.

The sheet barrier materials proposed and used for the sealed enclosures have high barrier properties. Thus the tobacco of the cigarettes contained in the enclosures are protected against changes in moisture content or losses of volatile flavour compounds. The consumer may thereby receive factory fresh cigarettes even if the package has been stored for a period significantly exceeding the sell-by date which would obtain if the package was of conventional construction.

In that the key merit of cigarette packages comprising a resealable barrier enclosure is the maintenance of original cigarette condition, it is of importance to the consumer to have an assurance when taking possession of such a package that there has occurred no prior opening of the package. It is thus an object of the subject invention to provide such a package with means offering such assurance to the consumer.

The subject invention provides a smoking article package having two major walls, two side walls, and two end walls, said package comprising:

a sealed enclosure of a layer of barrier material around a charge of smoking articles, a smoking article removal access aperture being defined in the barrier material layer, said aperture extending from the top end wall into one of said major faces of said package and there extending over said aperture, and extending beyond all of the edges thereof, a cover layer comprising a permanently tacky surface engageable with said barrier material layer adjacent to said edges of said aperture beyond said aperture and said layer comprising a non-adhesive pull-tab, whereby, after opening of said aperture said enclosure can be resealed by re-engaging said permanently tacky surface of said cover layer with said barrier material layer adjacent to said edges beyond said aperture; and a sheet material wrap disposed exteriorly of said enclosure and extending over at least a portion of said cover layer and over said barrier layer adjacent thereto, whereby the first opening of said smoking article removal access aperture cannot take place without said wrap being torn or partially or fully removed.

Preferably the wrap does not impede access to the pull-tab.

Preferably the sheet material wrap extends over the front and rear major walls, the two side walls and the bottom end wall of the sealed enclosure. Advantageously, at the location of the non-adhesive pull-tab of the cover layer, the sheet material wrap comprises an elongate, laterally extending opening. Suitably the non-adhesive pull-tab projects through said opening.

Alternatively, lines of weakening in the sheet material wrap may define an elongate flap, the flap comprising a non-weakened lower hinge line, such that, upon the flap being folded outwardly and downwardly about the hinge line, there exists an opening via which the non-adhesive pull-tab may be caused to extend.

In a further alternative, the opening in the sheet material wrap may be a single line of cut in said wrap through which the pull-tab extends.

Alternatively, the sheet material wrap extends over a portion of the front wall, the two side walls and the bottom end wall of the sealed enclosure. Advantageously, the sheet material wrap covers substantially all of the two side walls and the bottom end wall.

Preferably, the sheet material wrap extends over at least a portion of the cover layer and the barrier layer at the top end wall. Advantageously, the sheet material wrap extends over substantially all of the top end wall.

Alternatively, the sheet material wrap extends over a portion of the cover layer and the barrier layer at the front major wall. Suitably, there may be provided at least one line of weakening in the sheet material wrap, whereby the first opening of the smoking article removal access aperture cannot take place without said sheet material wrap being torn along said line of weakening.

In a yet further alternative the sheet material wrap extends over substantially all of the front major wall, of the sealed enclosure to substantially conceal the cover layer at the front major wall thereof.

Preferably, the sheet material wrap has a line of weakening therein. Advantageously, the sheet material wrap has a pull-tab, whereby the sheet material wrap may be torn, or partially or fully removed. Suitably, said pull-tab is located adjacent to either a side wall or the top wall of the package.

In order that the subject invention may be clearly understood and readily carried into effect reference will now be made, by way of example, to the drawings herewith, in which:—

Figure 1:
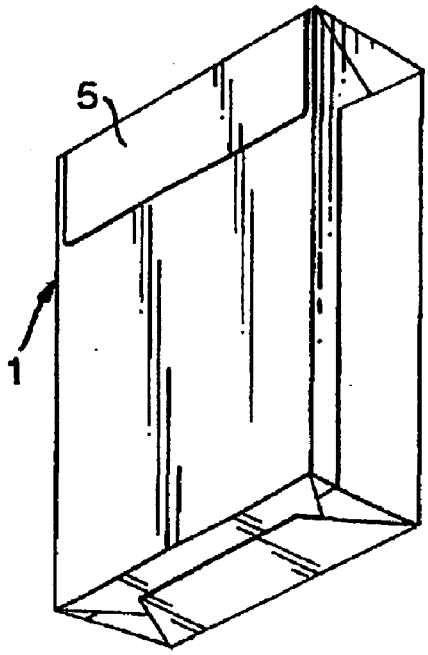
FIG. 1 shows a perspective view, from the rear and below, of a cigarette package of known type.
Figure 2:
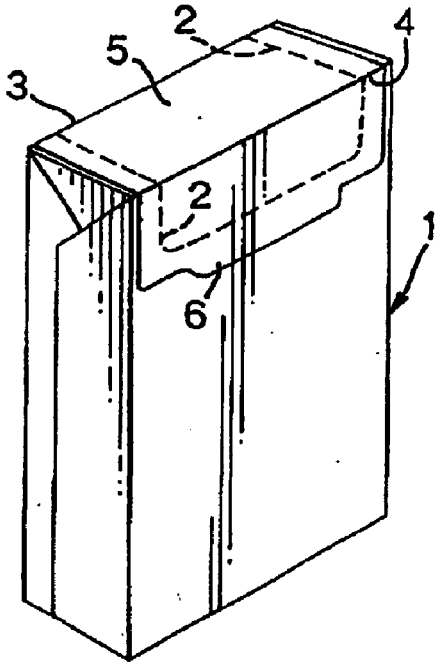
FIG. 2 shows a perspective view, from the front and above, of the cigarette package of FIG. 1.

The prior art cigarette package of FIGS. 1 and 2 comprises an enclosure 1 of flexible sheet barrier material. The barrier material may suitably be, for example, a metal foil/plastics laminate or a metallised plastics film.

As is readily observable from FIGS. 1 and 2, edge portions of the sheet barrier material are folded one over the other at the two side walls and at the bottom end wall of the enclosure 1. These overlapping edge portions of the barrier material are sealed by use, for example, of a heat activated sealant.

A cigarette access aperture of the enclosure 1 is bounded by a line 2 of weakening in the barrier material of the enclosure 1. As may be seen from FIG. 2, the aperture extends across the top end wall of the enclosure 1 from the rear edge 3 to the front edge 4 of the top end wall and into the front major wall of the enclosure 1, extending downwardly of the front major wall by about one sixth of the total height thereof. The rear edge 3 of the top end wall also bounds the access aperture, which aperture is thus completely defined by the line of weakening 2 in the barrier material and the edge 3 of the enclosure 1. A cover layer 5 of generally rectangular configuration is adhered, by the all-over application of adhesive at the under face thereof, to the barrier material of the enclosure 1 and extends at an upper portion of the rear major wall of the enclosure 1 (see FIG. 1) and, when the cover layer 5 is in the aperture closure position thereof, across the top end wall and at an upper portion of the front major wall (see FIG. 2). As is clearly seen from FIG. 2, at each end of the top end wall of the enclosure 1 the cover layer 5 extends beyond that portion of the access aperture which is defined at the top end wall. Similarly, and as can also readily be appreciated from FIG. 2, the cover layer 5 extends beyond all three sides of that portion of the access aperture which is defined by the line of weakening 2 at the front major wall of the enclosure 1.

At least in the continuous marginal zone of the under face of the cover layer 5 disposed outwardly of the defined access aperture at the top end wall and the front major wall of the enclosure 1 the adhesive applied thereto is a permanently tacky adhesive. The adhesive at that portion of the under face of the cover layer 5 which overlies the access aperture may be the same permanently tacky adhesive as is applied at the aforesaid marginal zone of the under face. The same permanently tacky adhesive may also constitute that which is employed for the purpose of anchoring the cover layer 5 at the rear wall of the enclosure 1 (FIG. 1).

Extending from the lower edge of the portion of the cover layer 5 which, as viewing FIG. 2, is at the front major wall of the enclosure 1, is a pull-tab 6. The under face of the pull-tab 6 is free of any adhesive and thus the pull-tab 6 does not adhere to the barrier material of the enclosure 1 and is therefore readily graspable by a consumer for the purpose of peeling back the cover layer 5 from the front major wall of the enclosure 1, and at least partially at the top end wall thereof, and thus peeling back to a corresponding extent, the portion of the barrier material defined by line of weakening 2, which portion is adhered to the cover layer 5, in order to remove a cigarette from the enclosure 1 via the access aperture bounded by the line of weakening 2.

Figure 3:
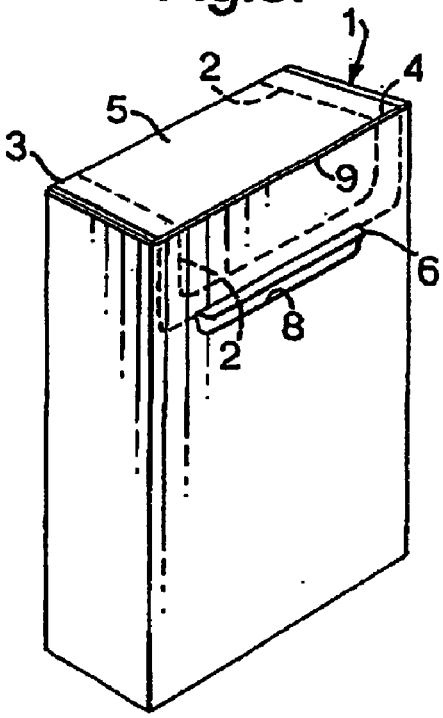
FIG. 3 shows a perspective view, from the front and above, of a cigarette package according to the subject invention.

The package shown in FIG. 3, which package is in accordance with the subject invention, comprises a package identical to the prior art package of FIGS. 1 and 2, but in addition the inventive package of FIG. 3 comprises an outer sheet material wrap 7. The wrap 7 extends over the front and rear major walls, the two side walls and the bottom end wall of the enclosure 1, but does not extend over the top end wall of the enclosure 1. Suitably, the wrap 7 is adhesively anchored to the enclosure 1 at a location(s) not shown.

At the outward surface thereof the wrap 7 bears indicia such, for example, as a brand name and/or logo. The package thus resembles in appearance a soft cup cigarette package.

At the location of the pull-tab 6 of the cover layer 5, the outer wrap 7 comprises an elongate, laterally extending opening 8. The pull-tab 6 projects, substantially perpendicularly of the enclosure 1 (once any overwrap material is removed), through the opening 8. The pull-tab 6 is thus readily graspable notwithstanding the presence of the wrap 7 about the enclosure 1.

At the first opening of the FIG. 3 package the pull-tab 6 is grasped for the purpose of peeling back the cover layer 5. In a first part of such peeling back action, the wrap 7 is perforce torn at that portion thereof between the opening 8 and the upper edge (9) of the wrap 7. This tearing of the wrap 7 constitutes a clear indication that access has been had to the interior of the package.

Suitably, the outer wrap 7 is of a relatively easily torn material, a paper for example.

To aid in the tearing of the wrap 7 by way of the first peeling pack of the cover layer 5, especially if the wrap 7 is of a material which is not easily tearable, two lines of weakening (not shown) may be provided, which lines extend from respective ends of the opening 8 to the edge 9 of the wrap 7.

There may be applied about the FIG. 3 package a fully enveloping protective overwrap of polyfilm, which overwrap is provided with a tear strip. Such an overwrap is conventional for soft cup packages and may be transparent. Suitably, before the overwrap is applied about the FIG. 3 package the pull-tab 6 is folded up in face-to-face contact with the outer wrap 7.

Advantageously, the FIG. 3 package comprises frame means (not shown in FIG. 3), which frame means is disposed between the aforesaid charge of cigarettes and walls of the enclosure 1. The frame means serves to impart to the FIG. 3 package a degree of rigidity which is absent from a conventional soft cup package.

Figure 4:
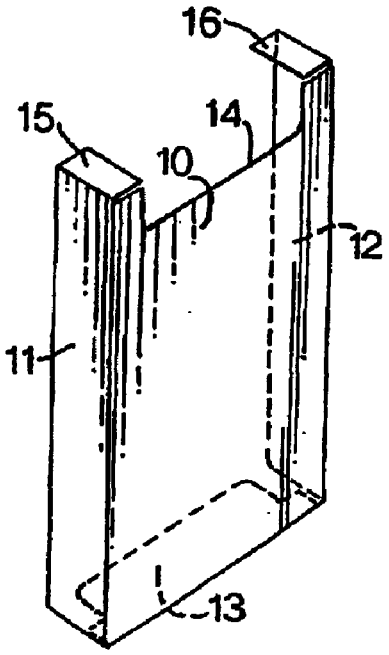
FIG. 4 shows a perspective view of an inner frame.

The frame means may take the form, for example, of the inner frame depicted in FIG. 4. That inner frame, which is generally as disclosed in WO98/22367 and WO98/22368, is formed of a stiff, foldable card or paper material. The inner frame comprises a major panel 10 of generally rectangular configuration and of height and width dimensions corresponding respectively to the height and width dimensions of the front major wall of the enclosure 1 of the FIG. 3 package. The inner frame further comprises side panels 11, 12, of height and width dimensions corresponding to those of the side walls of the enclosure 1, and a base panel 13.

Thus when frame means as per the FIG. 4 inner frame is incorporated in the FIG. 3 package, the panel 10 is disposed immediately behind the front major wall of the enclosure 1 and side panels 11, 12 are similarly disposed relatively of the respective side walls of the enclosure 1. The charge of cigarettes in the FIG. 3 package rests upon the base panel 13 when the package is in the orientation thereof as shown in FIG. 3.

The panel 10 of the FIG. 4 inner frame comprises a cutout 14, which cutout 14 is dimensioned and configured for registration with that portion of the access aperture of the enclosure 1 extending at the front major wall of the enclosure 1. Extending from the upper ends of side panels 11, 12 respectively are tabs 15, 16, which tabs 15, 16 extend inwardly to, or into the region of, the respective edges of that portion of the access aperture which extends at the top end wall of the enclosure 1.

When, after there has occurred an opening of the FIG. 3 package, the cover layer 5 is brought back to the aperture closure position thereof, and the permanently tacky adhesive at the margin of the cover layer 5 is pressed against the barrier material of the enclosure 1 to make good the resealing of the aperture, the tabs 15, 16 and portions of the panel 10 adjacent the cutout 14 serve to provide reaction surfaces, and to strengthen the upper surface or top of the package.

The configuration of the FIG. 4 inner frame is such as to impart to the FIG. 3 package sharp, right-angle corners at the junctures of the package front and rear walls with the side walls thereof. The inner frame may be alternatively configured such as to provide for bevelled or rounded corners at these junctures.

Whereas the opening 8 of the outer wrap 7 is provided by cutting the material of the wrap 7 in a closed elongate figure and removing and discarding the thus defined portion of the material, it is conceivable that an opening serving the same purpose could be provided otherwise. Thus, for example, lines of weakening could define an elongate flap, the flap comprising a non-weakened lower hinge line, such that, upon the flap being folded outwardly and downwardly about the hinge line, there exists an opening via which the pull-tab 6 may be caused to extend. According to another alternative, the opening takes the form of a single line of cut in the wrap 7, through which the pull-tab 6 extends.

The outer wrap 7 need not extend fully about the enclosure 1. For example, it may be the case that instead of the wrap 7 extending fully across the rear major wall of the enclosure 1, the wrap 7 extends at only edge portions of the rear major wall. Of course, if the wrap 7 does not extend fully about the enclosure 1, the wrap 7 must of necessity be anchored to the enclosure 1.

The outer wrap may extend over the top end wall of the enclosure 1. If the outer wrap extends fully over the top end wall of the enclosure 1, then at the first opening of the package the outer wrap will be torn not only at the major front wall of the package, but at the top end wall thereof as well. If the outer wrap does not extend at the front wall over the front of the cover layer but does extend over the top end wall of the enclosure, then at the first opening of the package the outer wrap will be torn but only at the top end wall thereof.

Figure 5:
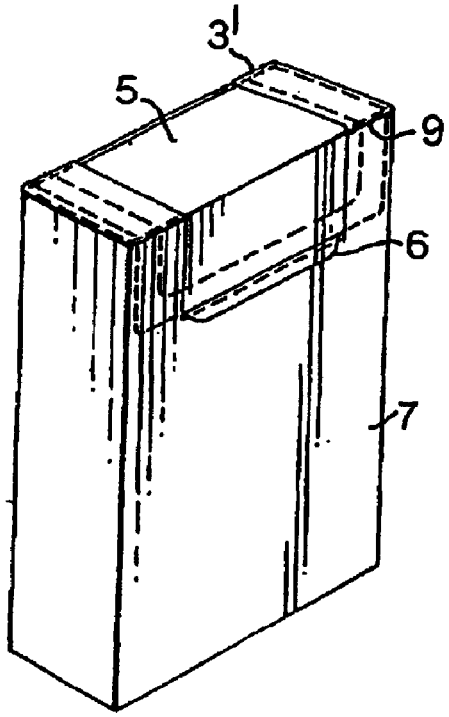
FIGS. 5–7 show a perspective view, from the front and above, each of alternative embodiments of the invention.

The package shown in FIG. 5, which package is in accordance with an alternative embodiment of the subject invention, comprises a package identical to the package of FIG. 3, but the sheet material wrap 7 extends over a portion of the front major wall and the top end wall, and all of the two side walls, the rear major wall and the bottom end wall. The wrap 7 is open over a portion of the front major wall and the top end wall, such that the pull-tab 6 may be grasped for the purpose of peeling back the cover layer 5. In the first part of such peeling back action, a portion of the wrap 7 is perforce torn. This tearing of the wrap 7 constitutes a clear indication that access has been had to the interior of the package.

To aid in the tearing of the wrap 7 by way of the first peeling back of the cover layer 5, especially if the wrap 7 is of a material which is not easily tearable, two lines of weakening (not shown) may be provided, which lines extend through the sheet material wrap from respective ends of the pull-tab 6 to the rear edge 3' of the wrap 7.

Figure 6:
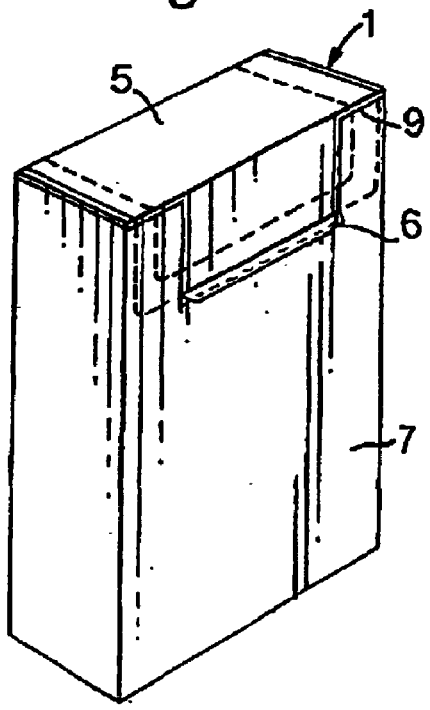

The package shown in FIG. 6, which is a package in accordance with a further alternative to the subject invention, comprises a package identical to the package of FIG. 5, but the sheet material wrap 7 extends over a portion of the cover layer 5 at the front major wall of the enclosure 1, and does not cover the top end wall of the enclosure 1.

Figure 7:
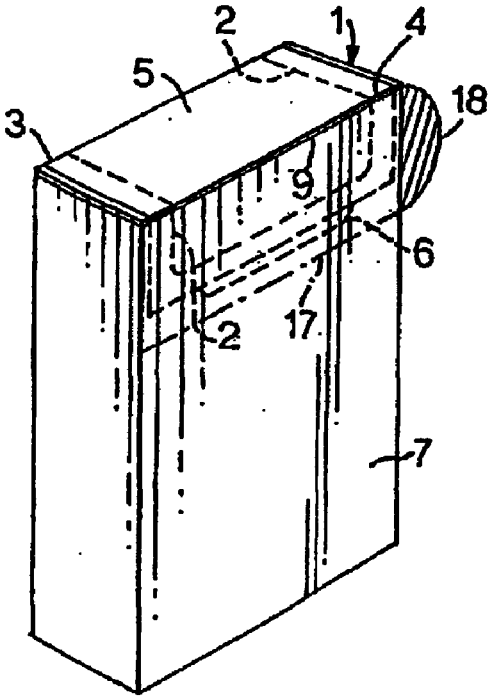

The package shown in FIG. 7, which is a package in accordance with a further alternative to the subject invention, comprises a package identical to the package of FIG. 3, but the sheet material wrap 7 extends over all of the front major wall, the two side walls, the bottom end wall and the rear major wall of the enclosure 1 to conceal the cover layer 5 at the front major wall thereof.

To aid the tearing of the wrap 7, there may be provided a line of weakening 17 extending at least between the two sides walls of the wrap 7, and a pull-tab 18, whereby the wrap 7 may be torn, or partially or fully removed, thereby providing access to the pull-tab 6.

Suitably, the pull-tab 18 is located adjacent to either a side wall or the top end wall of the enclosure 1.

Advantageously, any of the packages described may comprise frame means, which frame means is disposed between the aforesaid charge of cigarettes and the walls of the enclosure 1. The frame serves to impart to the package a degree of rigidity which is absent from the conventional soft cup package.

The frame means may take the form, for example, of the inner frame depicted in FIG. 4.

What is claimed is:

1. A smoking article package having a front wall, a back wall, two side walls, a top end wall, and a bottom end wall, said package comprising:

a sealed enclosure of a layer of barrier material around a charge of smoking articles, a smoking article removal access aperture being defined in the barrier material layer, said aperture extending from the top end wall into one of said front wall or said back wall of said package, extending over said aperture and extending beyond all of the edges of said aperture a cover layer comprising a permanently tacky surface engagable with said barrier material layer adjacent to said edges of said aperture beyond said aperture and said layers comprising a non-adhesive pull-tab, whereby, after peeling back of said cover layer exposing said aperture, said enclosure can be resealed by re-engaging said permanently tacky surface of said cover layer with said barrier material layer adjacent to said edges beyond said aperture; and a sheet material wrap disposed exteriorly of said enclosure and extending over at least a portion of said cover layer and over said barrier layer adjacent thereto, said sheet material wrap having an elongate, laterally extending openly whereby the first peeling back of said sealed enclosure at said access aperture cannot take place without said wrap being torn or partially or fully removed and said pull tab projects through said laterally extending opening.

2. A smoking article package according to claim 1, wherein said sheet material wrap does not impede access to said non-adhesive pull-tab.

3. A smoking article package according to claim 1, wherein said sheet material wrap extends over said front and rear walls, said two side walls and said bottom end wall of said sealed enclosure.

4. A smoking article package according to claim 1, wherein lines of weakening in the sheet material wrap define an elongate flap, the flap comprising a non-weakened lower hinge line, such that, upon the flap being folded outwardly and downwardly about said hinge line, there exists an opening via which said non-adhesive pull-tab may be caused to extend.

5. A smoking article package according to claim 1, wherein said laterally extending opening in said sheet material wrap may be a single line of cut in said wrap through which said pull-tab extends.

6. A smoking article package according to claim 1, wherein said sheet material wrap extends over a portion of said front wall, said side walls and said bottom end wall.

7. A smoking article package according to claim 6, wherein said sheet material wrap covers substantially all of said side walls and said bottom end wall.

8. A smoking article package according to claim 6, wherein said sheet material wrap extends over at least a portion of said cover layer and said barrier layer at said top end wall.

9. A smoking article package according to claim 8, wherein said sheet material wrap extends over substantially all of said top end wall.

10. A smoking article package according to claim 1, wherein said sheet material wrap extends over a portion of said cover layer and said barrier layer at said front wall.

11. A smoking article package according to claim 10, wherein there is at least one line of weakening in said sheet material wrap, whereby the first peeling back of said smoking article removal access aperture cannot take place without said sheet material wrap being torn along said at least one line of weakening.

12. A smoking article package according to claim 1, wherein said sheet material wrap extends over substantially all of said front wall of said sealed enclosure to substantially conceal said cover layer at the front wall thereof.

13. A smoking article package according to claim 12, wherein said sheet material wrap has a line of weakening therein.

14. A smoking article package according to claim 12, wherein said sheet material wrap has a pull-tab, whereby said sheet material wrap may be torn or partially or fully removed.

15. A smoking article package according to claim 14, wherein said sheet material pull-tab is located adjacent to either a side wall or said top end wall of said package.

16. A smoking article package according to claim 1, wherein said sheet material wrap is adhesively anchored to said sealed enclosure.

17. A smoking article package according to claim 1, said package comprising a frame, said frame being disposed between said charge of smoking articles and the walls of said enclosure.

18. A smoking article package, comprising:

a barrier material enclosure surrounding a plurality of smoking articles, said enclosure having an access aperture formed across a top end wall of said enclosure;

a cover layer extending over said access aperture in said enclosure and releasably adhered to said barrier material enclosure, said cover layer having a pull-tab;

a rupturable outer sheet material wrap extending over a portion of said access aperture, said outer sheet material having an elongate laterally extending opening and said pull-tab projects through said laterally extending opening.

19. The smoking article package of claim 18, wherein said access aperture is defined by a line of weakening in said barrier material enclosure.

20. The smoking article package of claim 19, wherein said line of weakening defines an area extending across said top wall from a rear edge to a front edge and into a front wall.

21. A smoking article package, comprising:

an enclosure of a barrier material surrounding a plurality of cigarettes and having an access aperture defined by an area of weakness, said enclosure having a front wall and a top wall, said access aperture formed along said top wall and said front wall;

a cover layer extending over said access aperture and adhesively applied to said enclosure, said cover layer having a pull-tab;

an outer sheet wrap adhesively anchored to said enclosure and extending over a portion of said cover layer and said barrier material, said outer sheet wrap having an elongated laterally extending opening, said pull tab projecting through said laterally extending opening.

* * * * *